US007063485B2

(12) United States Patent
Jordan et al.

(10) Patent No.: US 7,063,485 B2
(45) Date of Patent: Jun. 20, 2006

(54) TOP TENSIONED RISER

(75) Inventors: Travis R. Jordan, Houston, TX (US); Jeffrey D. Otten, Cypress, TX (US); Kent B. Davies, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 10/830,344

(22) Filed: Apr. 22, 2004

(65) Prior Publication Data

US 2005/0238440 A1 Oct. 27, 2005

(51) Int. Cl.
*E21B 43/00* (2006.01)

(52) U.S. Cl. ..... 405/224.4; 405/169; 405/170; 405/224.2

(58) Field of Classification Search ..... 405/224.2, 405/224.3, 224.4, 224.1, 224, 223.1, 169, 405/170
See application file for complete search history.

(56) References Cited

U.S. PATENT DOCUMENTS

| | | | | |
|---|---|---|---|---|
| 4,470,721 | A * | 9/1984 | Shotbolt | 405/224.4 |
| 4,615,646 | A * | 10/1986 | Langner | 405/169 |
| 4,871,282 | A * | 10/1989 | Jennings | 405/224 |
| 5,088,859 | A * | 2/1992 | Devlin | 405/224 |
| 5,905,212 | A * | 5/1999 | Moses et al. | 73/862.451 |
| 6,321,844 | B1 * | 11/2001 | Thiebaud et al. | 405/224.2 |
| 6,585,455 | B1 * | 7/2003 | Petersen et al. | 405/224.4 |
| 6,688,814 | B1 * | 2/2004 | Wetch et al. | 405/224.2 |

* cited by examiner

*Primary Examiner*—Frederick L. Lagman
(74) *Attorney, Agent, or Firm*—Nick A. Nichols, Jr.

(57) ABSTRACT

A top tensioned riser extends substantially vertically from a platform hull to the seabottom. The riser includes length adjustment at its upper end and is detachably connected to an anchor pile at its lower end. Riser tension is monitored via load cells incorporated in the riser porch. The riser is connected to one or more import/export flowlines or pipelines.

20 Claims, 4 Drawing Sheets

TOP TENSIONED RISER

BACKGROUND OF THE DISCLOSURE

The present invention relates to flowline risers, more particularly to top tensioned import/export flowline risers for a tension leg platform (TLP), for testing and producing hydrocarbon formations in offshore waters.

A top tensioned riser (TTR) takes advantage of the TLP's superior motion characteristics to provide cost-effective flowline risers. In deepwater, import/export risers would typically be of the steel catenary riser (SCR) type in which the pipeline is supported at a riser porch near keel level of the TLP and takes an arched or catenary path to the touchdown point or connection on the seabottom. As water depth and/or diameter of the SCR increases in deepwater, its weight and cost increases significantly. The SCR extends outwardly from the TLP where it is supported at its upper end. Due to the proximity of SCRs and tendons anchoring the TLP to the seabottom, interference between risers and tendons must be carefully analyzed and managed during installation and operation.

It is therefore an object of the present invention to provide a riser that avoids tendon interference.

It is another object of the present invention to provide a top tensioned riser extending substantially vertically from the seabottom.

It is another object of the present invention to provide a top tensioned riser incorporating length adjustment.

It is yet another object of the present invention to provide a top tensioned riser incorporating riser tension monitoring means.

It is another object of the present invention to provide a top tensioned riser without active motion compensation.

SUMMARY OF THE INVENTION

In accordance with the present invention, a top tensioned riser extends substantially vertically from a platform hull to the seabottom. The riser includes length adjustment at its upper end and is detachably connected to an anchor pile at its lower end. Riser tension is monitored via load cells incorporated in the riser porch. A flowline pipeline end termination (PLET) installation connects the riser to one or more import/export pipelines.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings. It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
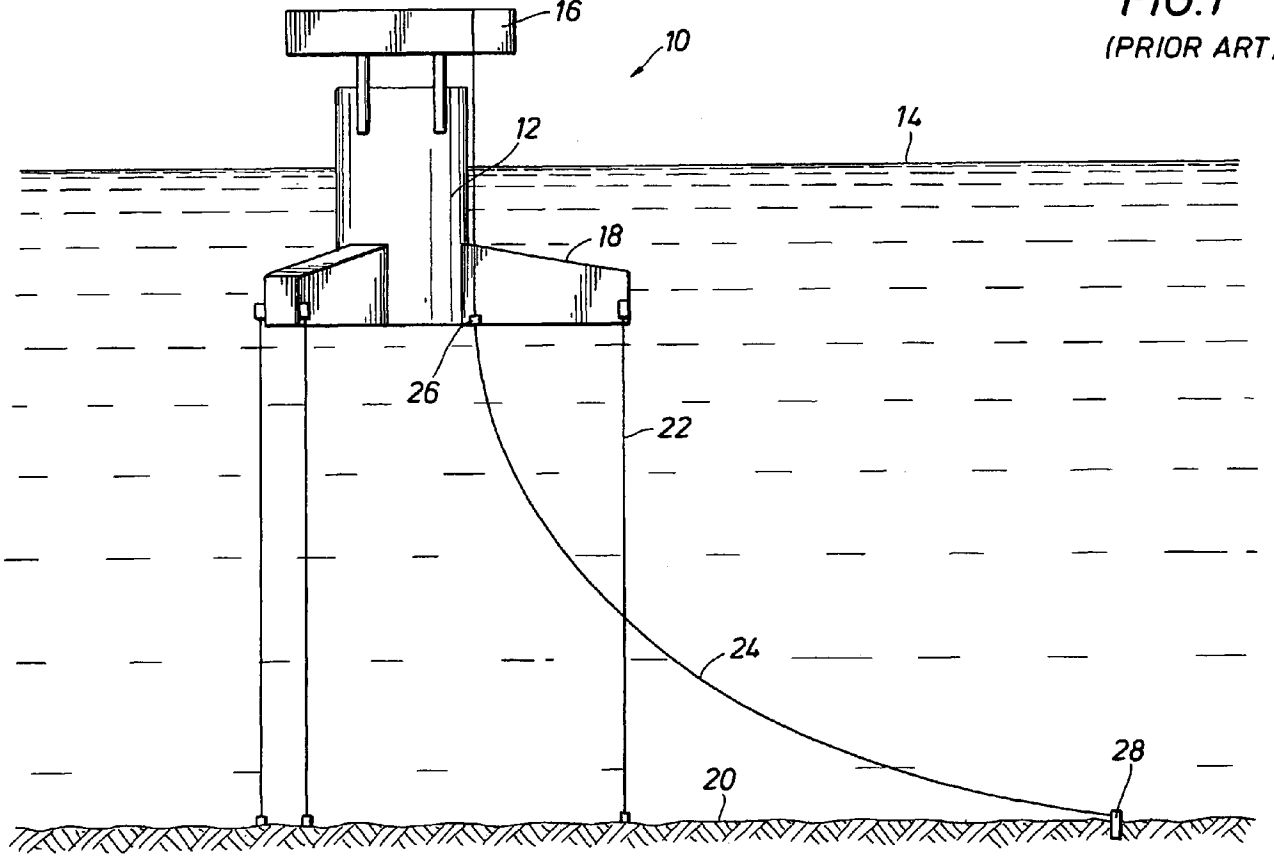
FIG. 1 (PRIOR ART)
FIG. 1 is a side view of a prior art steel catenary riser supported on a TLP illustrating the riser catenary path to the touchdown point on the seabottom.

Referring first to FIG. 1, a typical mono-column TLP platform, generally identified by the reference numeral 10, is shown. The platform 10 includes a column or hull 12 projecting above the water surface 14 supporting one or more platform decks 16 thereon. Pontoons 18 extend radially outward from the bottom of the hull 12. The platform 10 is anchored to the seabottom 20 by tendons 22. A steel catenary riser 24 is supported at a porch 26 near the keel level of the platform hull 12. The catenary riser 24 takes a catenary path to the touchdown point 28 on the seabottom 20. The riser 24 may be hundreds or thousands of feet in length and is freely suspended between the support porch 26 and the touchdown point 28. Ocean currents could therefore move the riser 24 so that it interferes with the tendons 22 under certain environmental conditions.

Figure 2:
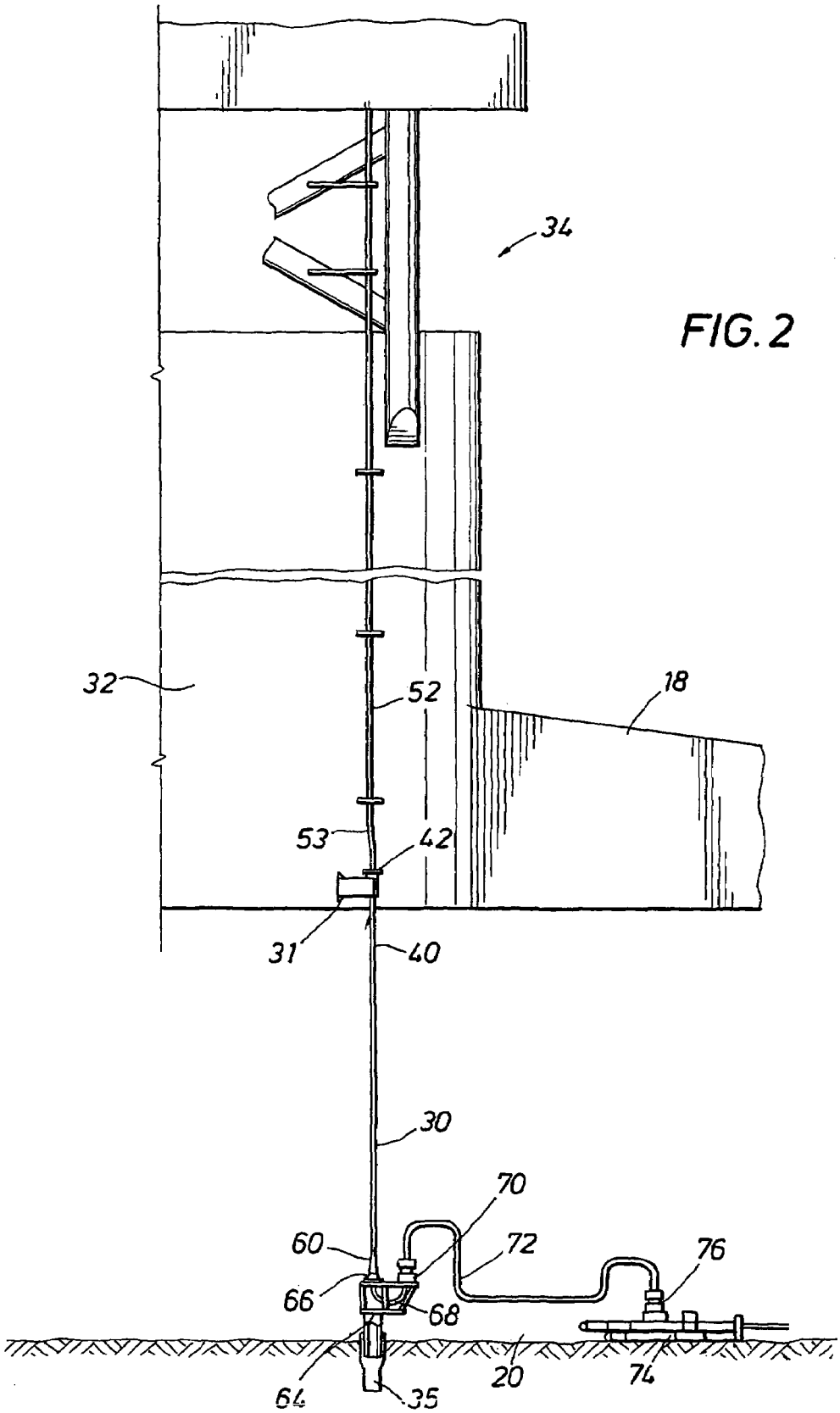
FIG. 2 is a partially broken away side view of a TLP depicting the top tensioned riser of the present invention secured near the keel of a platform hull.
Figure 4:
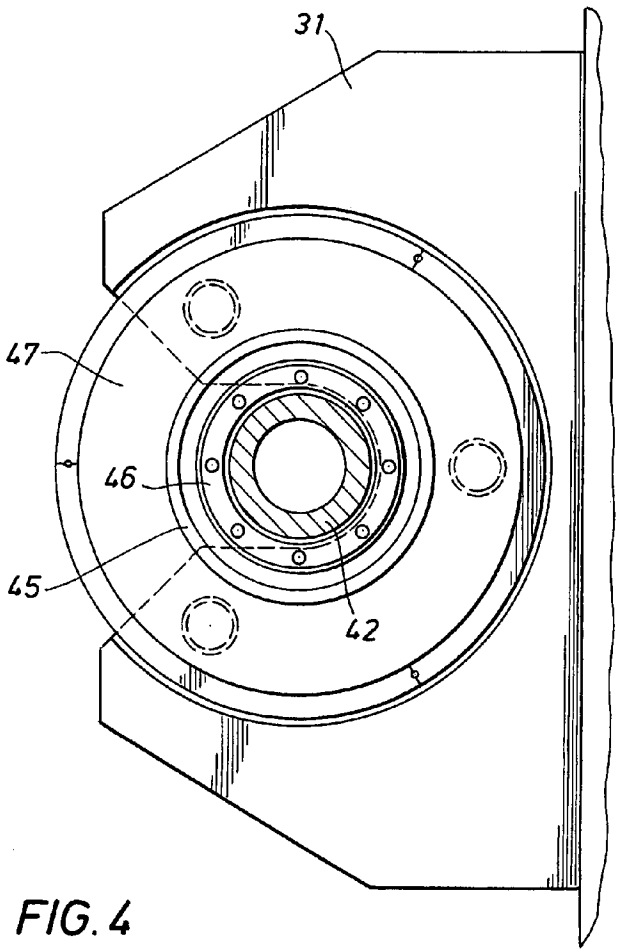
FIG. 4 is a top plan view of the upper connector assembly of the top tensioned riser of the present invention taken along line 4—4 of FIG. 3.

Referring now to FIG. 2, the top tensioned riser 30 of the present invention extends substantially vertically downward from a riser porch 31 located external to the hull 32 of a TLP platform 34 to an anchor pile 35 secured in the seabottom 20. The upper end of the riser 30 is supported by the riser porch 31 near the keel of the platform hull 32. The riser 30 is tensioned at installation to control stresses. However, the riser 30 is not maintained in constant tension as a conventional tensioned riser would be, rather its loads are allowed to fluctuate through a pre-calculated and permissible range. The riser 30 behaves similar to a tendon in this respect, but the tension in the riser 30 is much lower because it does not materially participate in the stationkeeping of the platform 34. The riser 30 is like a limp tendon that is installed at a location that reduces the dynamic forces exerted by the platform 34 on the riser 30.

In a preferred embodiment of the present invention, the riser 30 is installed similar to a preinstalled tendon 22. That is, the riser 30 is stalked together in vertical sections and terminated at the top end thereof with temporary buoyancy (not shown in the drawings) that supports the riser 30 in a substantially vertical position until the hull 32 is installed. Standard riser joints utilizing premium threaded and coupled connections connected end-to-end form the riser 30. Fairings are used to suppress vortex induced vibration (VIV). When the hull 32 is de-ballasted to establish pre-tension in the tendons 22, the riser 30 is also pretensioned, but to a lesser load. The riser 30 connects an import/export flowline to the TLP facilities.

The main riser joints forming the riser 30 of the present invention are similar to standard tubing with threaded and coupled connections. The bottom assembly of the riser 30 includes an open frame structure for securing the lower end of the riser 30 to the anchor pile 35. The upper end of the riser 30 terminates in an upper tapered stress joint 40 and length adjustment joint 42, shown in FIG. 3. The upper end of the riser 30 is locked off to the hull 32 and then pre-tensioned during de-ballasting of the hull 32 to a predetermined top tension.

Figure 3:
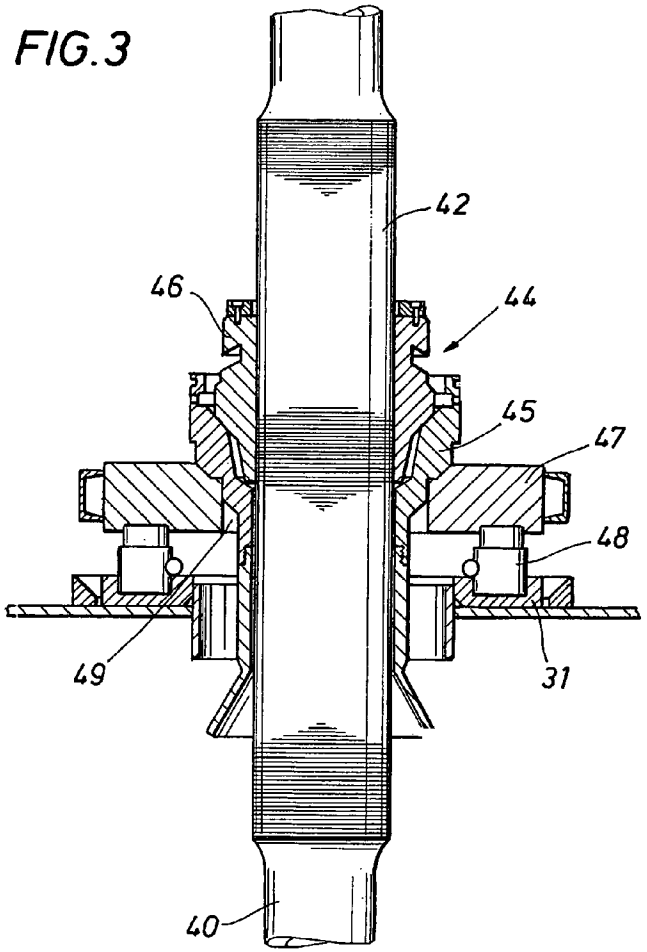
FIG. 3 is a partially broken away side view of the upper connector assembly of the top tensioned riser of the present invention secured near the keel of a platform hull.

Referring now to FIG. 3, the length adjustment joint 42 is welded or otherwise secured to the upper tapered stress joint 40 of the riser 30. The length adjustment joint 42 is externally threaded or grooved and extends through the riser porch 31. A riser lock off connector assembly 44 mounted on the length adjustment joint 42 permits adjustment of the length and tension of the riser 30. The lock off assembly 44 comprises a top termination riser connector 45, a segmented slip 46 and a plate 47 having a centrally located hole 49. The length adjustment joint 42 extends through the hole 49 of the plate 47 which is positioned in facing contact with load cells 48 embedded in the surface of the riser porch 31. The termination riser connector 45 and segmented slip 46 threaded on the length adjustment joint 42 engage the back side of the plate 46 to maintain it in contact with the load cells 48 and to lock the riser 30 to the riser porch 31. The tension in the riser 30 is monitored via the load cells 48 which are operatively connected to sensors relaying data to a monitor or the like located on the deck of the TLP platform. No external tensioning system is required. The upper end of the length adjustment joint 42 is connected to the hull piping 52 by a jumper joint 53, shown in FIG. 2.

Figure 5:
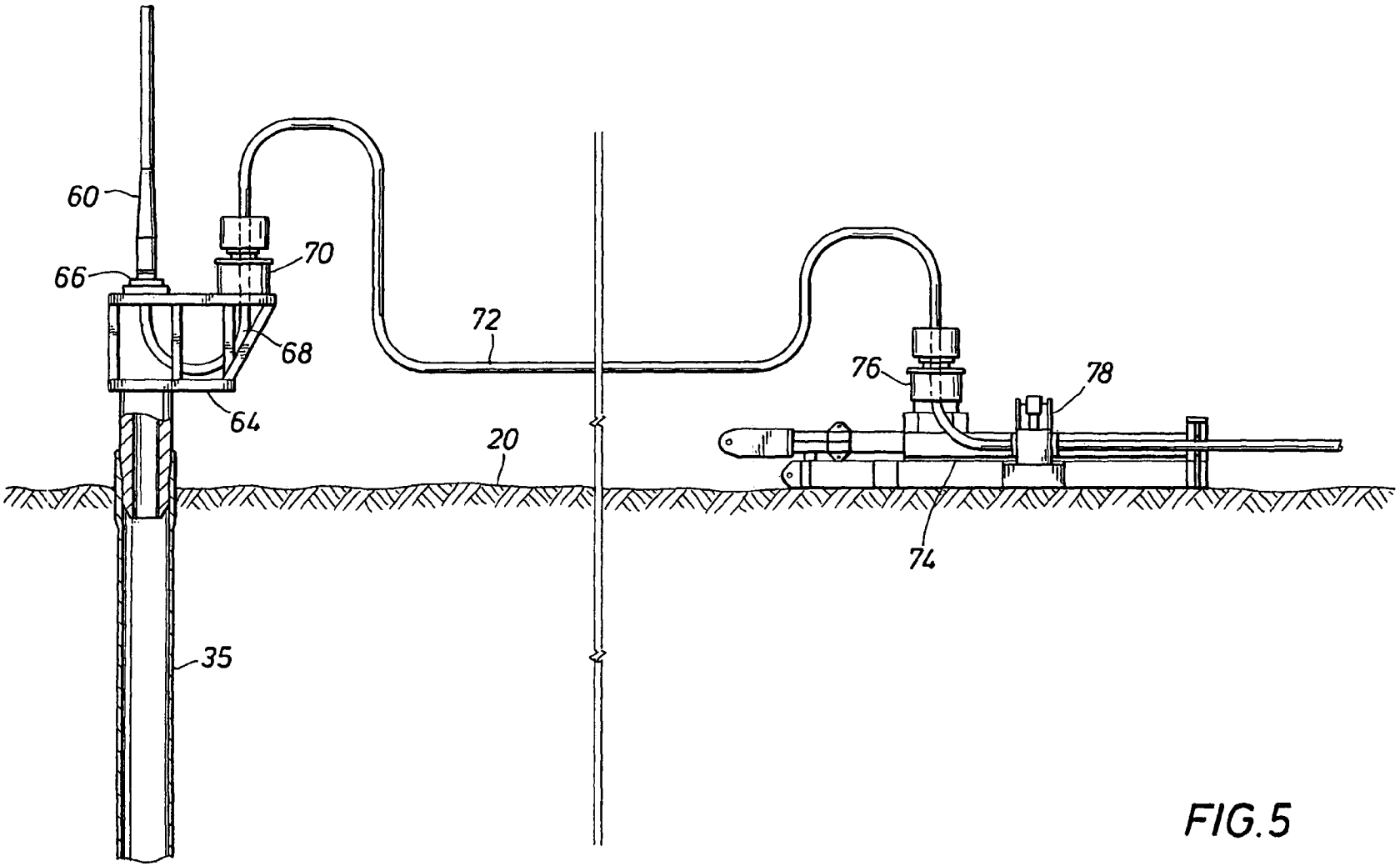
FIG. 5 is a side view illustrating the bottom assembly of the top tensioned riser of the present invention connected to a pile anchored to the seabottom.

Referring now to FIG. 5, the lower end of the riser 30 terminates in a tapered stress joint 60. An open frame support structure 64 is mounted on the lower distal end of the riser stress joint 60. A mandrel 65 extending downwardly from the bottom of the open frame support structure 64 anchors the riser 30 to the pile 35 installed in the seabottom 20 in a known manner. The mandrel 65 stabs into the upper end of the pile 35 projecting above the seabottom 20 and establishes a secure connection therewith. The open frame support structure 64 is provided with connectors required for establishing fluid communication between the riser 30 and import/export flowlines.

The tapered stress joint 60 of the riser 30 connects to an anchor flange 66 securing one end of a flowline loop 68 to the open frame support frame structure 64. The opposite end of the flowline loop 68 connects to a flowline connector hub 70 mounted on the support structure 64. A flowline jumper 72 connects a PLET 74 to the flowline connector hub 70. The PLET 74 includes a flowline connection hub 76 for establishing fluid communication with one or more import/export flowlines and/or pipelines. The PLET 74 incorporates isolation valves 78 to prevent flowline flooding and allow testing after the flowline jumper installation. The flowlines 68, 72 include 5D minimum radius bends to allow for pigging and other maintenance operations.

Riser installation, which may include one or more risers 30, may be done before or after installation of the TLP. For riser installation prior to installation of the TLP, the anchor pile 35 is first installed in the seabottom 20 in a known manner. The anchor pile 35 is sized for the expected load conditions and may be, for example, 36 inches in diameter and approximately 200 feet long made up with standard connectors. The lower riser stress joint 60 with the open frame support structure 64 mounted on the lower distal end thereof is the first joint forming the riser 30. Subsequent riser joints are connected end-to-end and run down until the riser 30 is formed. Upon completion of the riser 30, temporary buoyancy is provided at the upper end of the riser 30 to maintain it in a vertical position until the hull 32 is installed. The riser 30 is pressure tested and the lower end thereof is then locked in the anchor pile 31. Upon lowering of the hull 32 to the installation draft, the length adjustment joint 42 of the riser 30 is guided through the riser porch 31. The length of the riser 30 is adjusted as necessary. The length adjustment joint 42 provides about 4 feet of a threaded or grooved profile section for fine adjustments of the length of the riser 30. The riser 30 length is adjusted as necessary and the riser 30 is pre-tensioned to the installation tension and locked off to the hull 32. The temporary buoyancy is removed and the hull piping 52 is then connected to the length adjustment joint 42. The PLET installation may be installed before or after the riser 30 is installed. If the PLET is already in place, the flowline connections are made to establish fluid flow communication with the import/export flowlines and/or pipelines.

If the riser 30 is installed after installation of the TLP, a similar installation sequence is followed. After the TLP is installed, a crane mounted on the TLP deck or a heavy lift vessel moored adjacent to the TLP is used to install the riser 30. As in the installation sequence described above, the lower riser stress joint 60 with the open frame support structure 64 mounted on the lower distal end thereof is the first joint forming the riser 30. Subsequent riser joints are connected end-to-end and run down until the riser 30 is formed. The crane or heavy lift vessel tensions and holds the riser 30 while it is guided into the riser porch 31. The length of the riser 30 is adjusted as necessary and the riser 30 is pre-tensioned to the installation tension and locked off to the hull 32. The hull piping 52 is then connected to the length adjustment joint 42. The PLET 74 is installed, if it is not already in place, and the flowline connections are made to establish fluid flow communication with the import/export flowlines and/or pipelines.

While preferred embodiments of the invention has been shown and described, other and further embodiments of the invention may be devised, such as utilizing the top tensioned riser of the invention with a multi-column TLP, without departing from the basic scope thereof, and the scope thereof is determined by the claims that follow.

The invention claimed is:

1. A flowline riser, comprising:

a) a plurality of riser joints connected end-to-end forming said riser;

b) said riser including an upper joint adapted for connection to a platform hull and a lower joint adapted for connection to an anchor pile embedded in a seabed;

c) said upper joint including a length adjustment section for adjusting the length and tension of said riser; and d) wherein said riser extends substantially vertically between said platform hull and said anchor pile.

2. The riser of claim 1 including means for monitoring the tension of said riser.

3. The riser of claim 2 wherein said monitoring means comprises load cells incorporated in a riser porch securing said riser to said platform hull, said load cells being operatively connected to remote monitoring means.

4. The riser of claim 1 including a flowline jumper connecting said riser to a PLET installation.

5. The riser of claim 1 including a flowline jumper connecting said riser to a pipeline.

6. The riser of claim 1 including a riser lock off connector mounted on said length adjustment section of said flowline.

7. The riser of claim 1 including connector means mounted on said lower joint for securing a lower end of said riser to said anchor pile.

8. The riser of claim 7 wherein said connector means comprises a frame structure including a mandrel for locking engagement with said anchor pile and a flowline loop forming a fluid passageway between said lower end of said riser and a flowline connector hub.

9. A riser installation, comprising:

a) a riser flowline secured substantially vertically between a floating platform and anchor means embedded in a seabed;

b) said riser flowline including an upper joint adapted for connection to said platform and a lower joint adapted for connection to said anchor means;

c) said upper joint including a length adjustment section for adjusting the length and tension of said riser flowline; and d) a flowline jumper establishing fluid communication between said riser flowline and a remote fluid source.

10. The riser installation of claim 9 wherein said remote fluid source is an import/export flowline.

11. The riser installation of claim 9 wherein said remote fluid source is a pipeline.

12. The riser installation of claim 9 including a PLET installation.

13. The riser installation of claim 9 including load cells incorporated in a riser porch securing said riser flowline to said platform for monitoring the tension of said riser flowline, said load cells being operatively connected to remote monitoring means.

14. The riser installation of claim 9 including a connector mounted on said lower joint for securing a lower end of said riser to said anchor means, said connector including a flowline loop fanning a fluid passageway between said riser flowline and a flowline connector hub, and wherein one end of said flowline jumper is connected to said flowline connector hub.

15. A method of installing a flowline riser, comprising the steps of:

a) forming said riser by joining riser joints end-to-end;

a) connecting a lower end of said riser to anchor means pre-installed in a seabed;

b) supporting said riser in a substantially vertical position;

c) attaching an upper end of said riser to a floating platform;

d) adjusting the length and tension of said riser;

e) locking off said riser;

f) connecting said riser to platform piping; and g) establishing fluid communication between said riser and a remote fluid source.

16. The method of claim 15 including providing temporary buoyancy to maintain said riser in a substantially vertical position prior to installation of the floating platform.

17. The method of claim 15 including connecting said riser to a PLET installation.

18. The method of claim 15 including installing import/export flowlines on the seabed prior to installing said riser.

19. The method of claim 15 including installing subsea flowlines on the seabed after installation of said riser.

20. The method of claim 15 including disconnecting and uninstalling said riser without uninstalling subsea flowlines connecting said riser to the remote fluid source.

* * * * *